US009889645B2

(12) United States Patent
Kimura et al.

(10) Patent No.: US 9,889,645 B2
(45) Date of Patent: Feb. 13, 2018

(54) INKJET HEAD AND INK JET PRINTING APPARATUS USING THE HEAD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Mamoru Kimura, Shizuoka-ken (JP); Noboru Nitta, Kannami Tagata Shizuoka (JP); Teruyuki Hiyoshi, Izunokuni Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/966,339

(22) Filed: Dec. 11, 2015

(65) Prior Publication Data

US 2016/0167378 A1 Jun. 16, 2016

(30) Foreign Application Priority Data

Dec. 11, 2014 (JP) ..... 2014-251293

(51) Int. Cl.
*B41J 2/045* (2006.01)

(52) U.S. Cl.
CPC ..... *B41J 2/04588* (2013.01); *B41J 2/0459* (2013.01); *B41J 2/04541* (2013.01); *B41J 2/04573* (2013.01); *B41J 2/04581* (2013.01); *B41J 2/04586* (2013.01); *B41J 2/04591* (2013.01)

(58) Field of Classification Search
CPC ..... B41J 2/04595; B41J 2/04573
See application file for complete search history.

(56) References Cited

U.S. PATENT DOCUMENTS 6,302,508 B1 * 10/2001 Asauchi ..... B41J 2/2135 347/15
6,454,377 B1 * 9/2002 Ishizaki ..... B41J 2/04541 347/10
6,568,778 B1 * 5/2003 Sekiya ..... B41J 2/04551 347/12
2002/0054311 A1 * 5/2002 Kubo ..... B41J 2/04588 358/1.13
2006/0214899 A1 * 9/2006 Kondo ..... B41J 2/04521 345/94
2007/0126769 A1 * 6/2007 Usui ..... B41J 2/0458 347/15

(Continued)

FOREIGN PATENT DOCUMENTS

JP 2012-045780 3/2012

*Primary Examiner* — Shelby Fidler
(74) *Attorney, Agent, or Firm* — Amin, Turocy & Watson LLP

(57) ABSTRACT

In accordance with an embodiment, an inkjet head comprises an ejection section and a driving section. The ejection section ejects ink according to the operations of an actuator. In order to make the ejection section eject different amount of ink for different drops, the driving section applies voltage to the actuator of the ejection section such that the ejection section ejects ink continuously based on the printing data indicating the times the ejection section ejects ink and a position flag designating a drop frame number where ink starting to be ejected.

3 Claims, 14 Drawing Sheets

(56) References Cited

U.S. PATENT DOCUMENTS

| | | | | |
|---|---|---|---|---|
| 2007/0146397 | A1* | 6/2007 | Silverbrook | B41J 2/155 347/5 |
| 2009/0231372 | A1* | 9/2009 | Shibata | B41J 2/04541 347/11 |
| 2010/0039469 | A1 | 2/2010 | Shimosato et al. | |
| 2010/0103212 | A1* | 4/2010 | Tabata | B41J 2/04548 347/10 |
| 2013/0257945 | A1* | 10/2013 | Shinkawa | B41J 2/04541 347/10 |
| 2014/0035979 | A1* | 2/2014 | Tamura | B41J 2/07 347/11 |
| 2014/0160194 | A1 | 6/2014 | Ono et al. | |
| 2014/0160195 | A1 | 6/2014 | Ono et al. | |
| 2014/0176627 | A1* | 6/2014 | Ono | B41J 2/04541 347/10 |
| 2015/0054872 | A1 | 2/2015 | Hiyoshi et al. | |

* cited by examiner

FIG.6

(a)

| | |
|---|---|
| TIMER SET Ta | t0a,t1a,t2a, ... t10a |
| TIMER SET Tb | t0b,t1b,t2b, ... t10b |
| TIMER SET Tc | t0c,t1c,t2c, ... t10c |
| TIMER SET Td | t0d,t1d,t2d, ... t10d |

(b)

| | |
|---|---|
| TIMER SET Ta | t0a,t1a, ... t9a,tdp |
| TIMER SET Tb | t0b,t1b, ... t9b,tdp |
| TIMER SET Tc | t0c,t1c, ... t9c,tdp |
| TIMER SET Td | t0d,t1d, ... t9d,tdp |

FIG.7

| DROP FRAME NUMBER | TIMER SET |
|---|---|
| 1 | TIMER SET Ta |
| 2 | TIMER SET Tb |
| 3 | TIMER SET Tc |
| 4 | |
| 5 | |
| 6 | |
| 7 | |

FIG.8

| PRINTING DATA | DROP SEQUENCE | NUMBER OF DROP FRAMES |
|---|---|---|
| 000 | 0000000000 | 0 |
| 001 | 0001000000 | 1 |
| 010 | 0001100000 | 2 |
| 011 | 0001110000 | 3 |
| ⋮ | | |
| 111 | 0001111111 | 7 |

FIG.9

| POSITION FLAG | DROP SEQUENCE |
|---|---|
| 1 | 1110000000 |
| 2 | 0111000000 |
| 3 | 0011100000 |
| 4 | 0001110000 |
| ⋮ | |
| 8 | 0000000111 |

INKJET HEAD AND INK JET PRINTING APPARATUS USING THE HEAD

CROSS-REFERENCE TO RELATED APPLICATION

This application is based upon and claims the benefit of priority from Japanese Patent Application No. 2014-251293, filed Dec. 11, 2014, the entire contents of which are incorporated herein by reference.

FIELD

Embodiments described herein relate generally to an inkjet head and a printing apparatus.

BACKGROUND

A printing apparatus ejects ink once or a plurality of times on paper based on printing data to form images. An inkjet head ejects a given amount of ink every time. Thus, conventionally, there is a problem that the inkjet head cannot finely adjust the amount of ink to be ejected on the paper.

BRIEF DESCRIPTION OF THE DRAWINGS

FIG. 6 is a diagram illustrating an example of constitution of a timer set according to the embodiment;

FIG. 7 is an example of a timer set selection table that is stored in a timer set-drop application register according to the embodiment;

FIG. 8 is a block diagram illustrating an example of constitution of printing data according to the embodiment;

FIG. 9 is a block diagram illustrating another example of the constitution of the printing data according to the embodiment;

DETAILED DESCRIPTION

In accordance with an embodiment, an inkjet head comprises an ejection section and a driving section. The ejection section ejects ink according to the operations of an actuator. In order to make the ejection section eject different amount of ink for different drops, the driving section applies voltage to the actuator of the ejection section such that the ejection section ejects ink continuously based on the printing data indicating the times the ejection section ejects ink and a position flag designating a drop frame number where ink starting to be ejected.

Hereinafter, the present embodiment is described with reference to the accompanying drawings.

Though in the present embodiment the inkjet head is a share mode or a shared-wall system, the inkjet head is not limited to a specific system.

Figure 1:
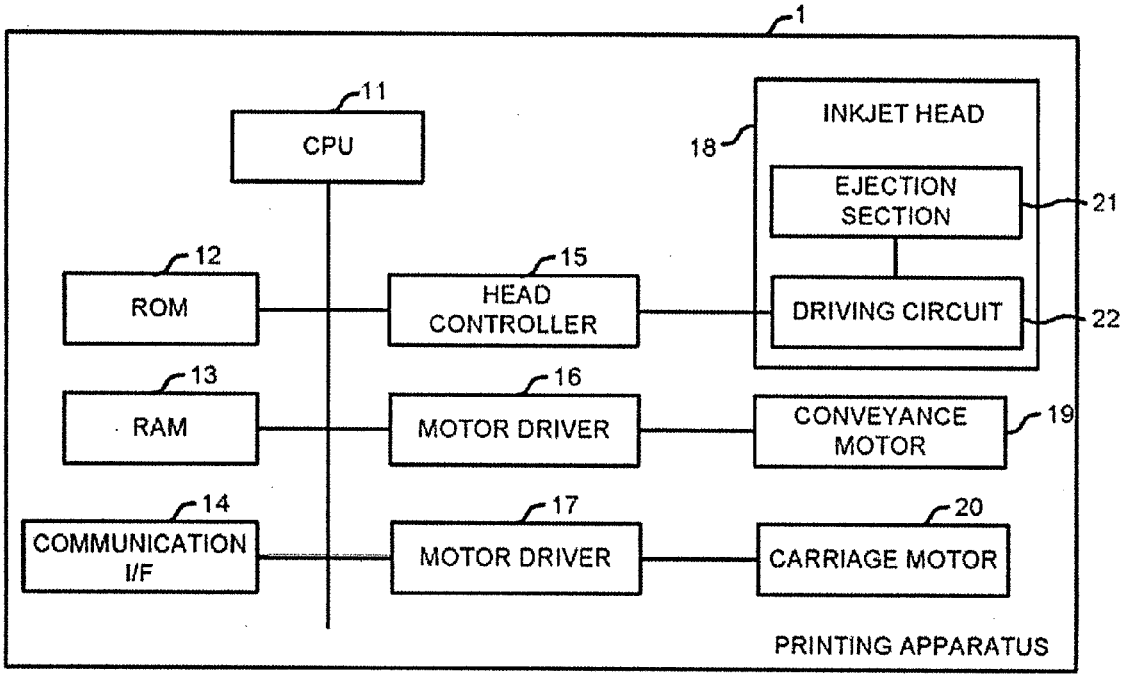
FIG. 1 is a block diagram illustrating an example of constitution of a printing apparatus according to an embodiment.

FIG. 1 is a block diagram illustrating an example of constitution of a printing apparatus according to the embodiment.

In the constitution example shown in FIG. 1, a printing apparatus 1 comprises a CPU 11, a ROM 12, a RAM 13, a communication I/F 14, a head controller 15, motor drivers 16 and 17, an inkjet head 18, a conveyance motor 19 and a carriage motor 20.

The CPU 11 controls the whole printing apparatus 1. The CPU 11 is a processor which executes programs to realize various processing. The CPU 11 connects with all sections inside the printing apparatus 1 through a system bus and the like. According to an operation instruction from an external device, the CPU 11 outputs the operation instruction to each section of the printing apparatus 1, and then informs the external device of various information acquired from each section of the printing apparatus 1.

The ROM 12 is a non-volatile memory which stores programs and control data in a non-rewritable manner. The RAM 13 is a volatile memory. The RAM 13 is a working memory, or a buffer memory. The CPU 11 executes the programs stored in the ROM 12 to realize various processing while using the RAM 13. Further, the printing apparatus 1 may include a non-volatile rewritable memory.

The communication I/F 14 is an interface used to communicate with the external device. For example, the communication I/F 14 receives a print data corresponding to a print request from the external device. As long as the communication I/F 14 is an interface used to carry out data transmission/reception with the external device, no limitation is given to its form. For example, the communication I/F 14 may be connected to the external device locally, or may be a network interface used to communicate with the external device via a network.

The head controller 15 drives the inkjet head 18 based on signals from the CPU 11. The head controller 15 is electrically connected to a driving circuit 22 of the inkjet head 18. The CPU 11 transmits the print data and control signals to the driving circuit 22 through the head controller 15. The control signals may be a shift clock signal, a latch pulse signal, a timing pulse signal and the like. The head controller 15 may also supply electric power, a clock signal and a reset signal to the driving circuit 22.

The motor driver 16 drives the conveyance motor 19 based on the instructions from the CPU 11. The motor driver 17 drives the carriage motor 20 based on the instructions from the CPU 11.

The conveyance motor 19 drives a roller for conveying a printing medium used in the printing process by the printing apparatus 1 based on the instructions from the motor driver 16. For example, the conveyance motor 19 drives a pickup roller, a conveyance roller and the like. The CPU 11 controls the conveyance motor 19 through the motor driver 16 to send the printing medium to positions where the inkjet head 18 ejects ink.

The carriage motor 20 drives a roller which is connected with a carriage comprising the inkjet head 18 based on the instructions from the motor driver 17. The CPU 11 controls the carriage motor 20 through the motor driver 17 to arrange the inkjet head 18 to predetermined positions.

The inkjet head 18 ejects ink on the printing medium based on the instructions from the head controller 15. That is, the CPU 11 enables the inkjet head 18 to eject ink with the head controller 15. The inkjet head 18 comprises an ejection section 21 and the driving circuit 22.

The ejection section 21 ejects ink on the printing medium based on the signals from the driving circuit 22. The ejection section 21 fills a pressure chamber with ink using the voltage applied by the driving circuit 22, and ejects the filled ink on the printing medium.

The conveyance motor may convey the printing medium at a constant speed at a right angle to the direction of nozzle row of the inkjet head, and drive a fixed inkjet head to carry out printing processing, or may convey the carriage motor at a constant speed at a right angle to the direction of nozzle row of the inkjet head to carry out printing processing in a state in which the printing medium is still. It may also be constituted in such a manner that in a state in which both the conveyance motor and the carriage motor are stopped, the inkjet head is driven to make the ink adhere to the printing medium, and then either the conveyance motor or the carriage motor moves a little to print at other position. The conveyance motor and the carriage motor may either have one integrated axis orthogonal to each other, or have two axes orthogonal to each other respectively.

For example, the printing medium is a paper, and it is not limited to a specific medium. The printing apparatus may print on a three-dimensional structure directly, may be an apparatus which forms the three-dimensional structure directly though the printing, or may be a printing apparatus which may dispense ink to the fine dispensing grooves of the printing medium. Further, the printing apparatus 1 may also not comprise the motor driver 16, the motor driver 17, the conveyance motor 19, and the carriage motor 20. In this case, the printing apparatus may print an image on a fixed printing medium or on a printing medium conveyed by other apparatus.

Figure 2:
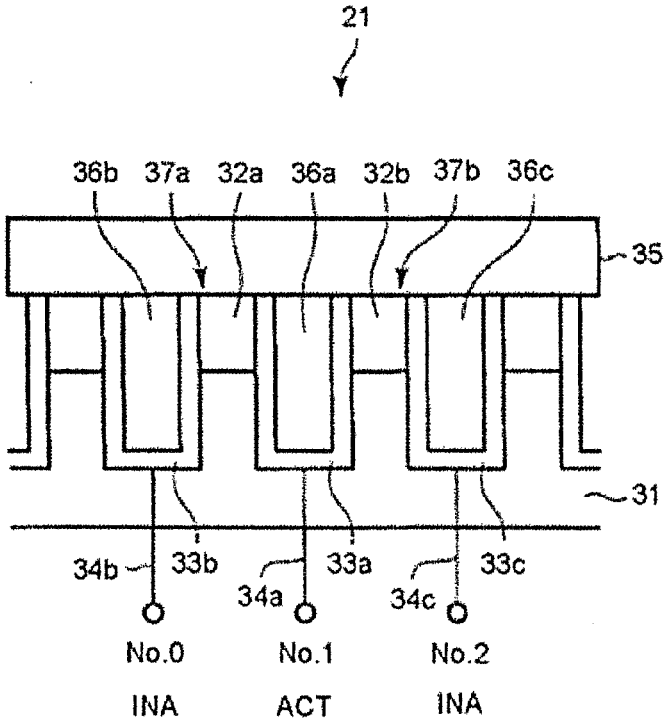
FIG. 2 is a cross-sectional view schematically illustrating an ejection section according to the embodiment.

FIG. 2 is a cross-sectional view schematically illustrating the ejection section 21.

As shown in FIG. 2, the ejection section 21 comprises a first piezoelectric member 31, second piezoelectric members 32*a* and 32*b*, electrodes 33*a*~33*c*, leads 34*a*~34*c* and a top plate 35.

The ejection section 21 has a constitution in which the first piezoelectric member 31 is joined to a top surface of a base plate (not shown), and the second piezoelectric member 32 is joined to the first piezoelectric member 31. The first piezoelectric member 31 and the second piezoelectric member 32 are polarized in the opposite directions along the thickness direction of plate to be joined with each other. The ejection section 21 is provided with many long grooves from one end towards the other end of each of the joined first piezoelectric member 31 and the second piezoelectric member 32. The grooves are arranged in parallel to each other and at given intervals.

The first piezoelectric member 31 and the second piezoelectric member 32*a* constitute an actuator 37*a*. Similarly, the first piezoelectric member 31 and the second piezoelectric member 32*b* constitute an actuator 37*b*. A voltage is applied from the driving circuit 22 to the actuators 37*a* and 37*b* through the electrode 33. By applying the voltage, the actuators 37*a* and 37*b* change the volume of the pressure chamber 36*a*.

The electrodes 33*a*~33*c* are arranged on the side wall and bottom of each groove in the ejection section 21. The leads 34*a*~34*c* which direct from the inside to the outside of each grove and extend from the electrodes 33*a*~33*c* are arranged in the ejection section 21.

The top plate 35 is arranged above the grooves in the ejection section 21. The top plate 35 and the electrode 33*a* constitute a pressure chamber 36*a* inside. Similarly, the top plate 35 and the electrode 33*b* constitute a pressure chamber 36*b* inside. The top plate 35 and the electrode 33*c* constitute a pressure chamber 36*c* inside.

In order to fill ink, the pressure chamber 36 is connected with a supply port which receives the supply of ink from an ink tank (not shown). Further, the pressure chamber 36 is connected with an ejection port for ejecting ink.

The electrode 33*a* and the electrode 33*b* apply a voltage to the actuator 37*a*. That is, a difference of voltages between the voltage applied by the electrode 33*a* and the voltage applied by the electrode 33*b* is applied to the actuator 37*a*. Similarly, the electrode 33*a* and the electrode 33*c* apply a voltage to the actuator 37*b*.

In the example shown in FIG. 2, the channels for ejecting ink are applied with reference numerals No. 0~ No. 2, and the ejection section 21 may be provided with much more channels.

The ejection section 21 drives two actuators 37 and three electrodes 33 to eject (drop) the ink from nozzles arranged in one pressure chamber 36 on the printing medium.

For example, in a case of ejecting ink from the No. 1 channel, the ejection section 21 drives the actuators 37*a* and 37*b* to eject the ink from the nozzles arranged in a pressure chamber 36*a* to the printing medium. When one channel is ejecting ink, the adjacent channels to the one channel cannot eject ink at the same time.

For example, in a case of ejecting ink from the No. 1 channel, the ejection section 21 cannot eject ink from the No. 0 channel and the No. 2 channel.

The ejection operation is carried out three times by shifting channels one by one, and in this way, the ejection section 21 can eject ink from any one of all the channels.

The ejection section 21 can continuously eject ink from the channels for a plurality of times. For example, based on an instruction from the driving circuit 22, the ejection section 21 ejects ink to a thick-print part for a plurality of times and ejects ink once or a few times to a thin-print part. The ejection section 21 can control the number of times of ejecting ink to adjust the shade of color. It is assumed herein that the ejection section 21 can continuously eject ink from the channels for seven times. Further, the number of the times that the ejection section 21 can continuously eject ink is not limited to a specific number of times.

Figure 3:
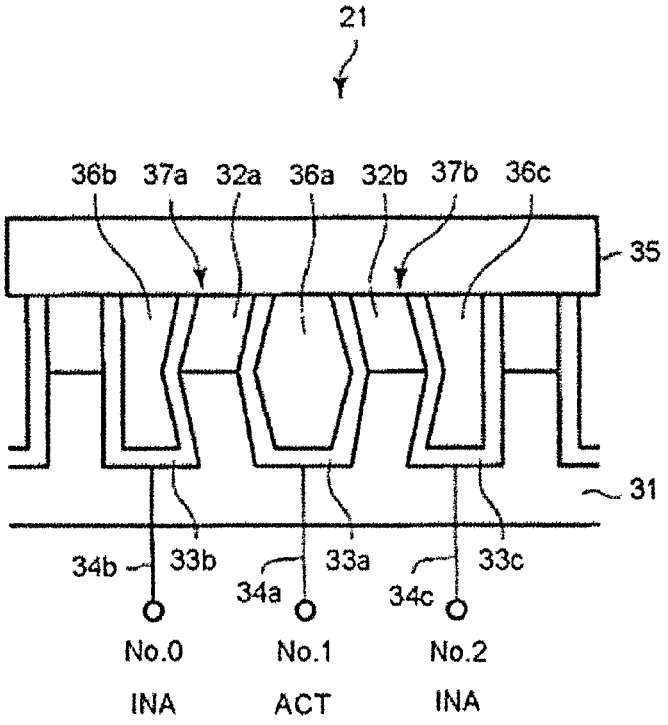
FIG. 3 is a cross-sectional view illustrating a case in which the ejection section is in a PULL state according to the embodiment.

FIG. 3 is a cross-sectional view schematically illustrating the ejection section 21 that is in a state (PULL state) in which the ink is filled.

In the example shown in FIG. 3, the channel capable of ejecting ink is the No. 1 channel.

In order to fill ink, the driving circuit 22 applies a voltage to the actuators 37*a* and 37*b* through the electrodes 33*a*~33*c* to drive the actuators. As a result, the actuators 37*a* and 37*b* deform as shown in FIG. 3.

As shown in FIG. 3, the actuator 37*a* bends towards the inside of the pressure chamber 36*b* of the No. 0 channel serving as the adjacent channel. Similarly, the actuator 37*b* bends towards the inside of the pressure chamber 36*c* of the No. 2 channel serving as the adjacent channel.

As a result, the volume of the pressure chamber 36*a* increases when compared to the release state (the state shown in FIG. 2), and the ink is filled from the ink supply port to the inside of pressure chamber 36*a*.

When returning from the PULL state to the release state, the volume of the pressure chamber 36*a* returns to its initial state. In this way, the ejection section 21 ejects ink from an ejection port corresponding to the No. 1 channel on the printing medium.

Figure 4:
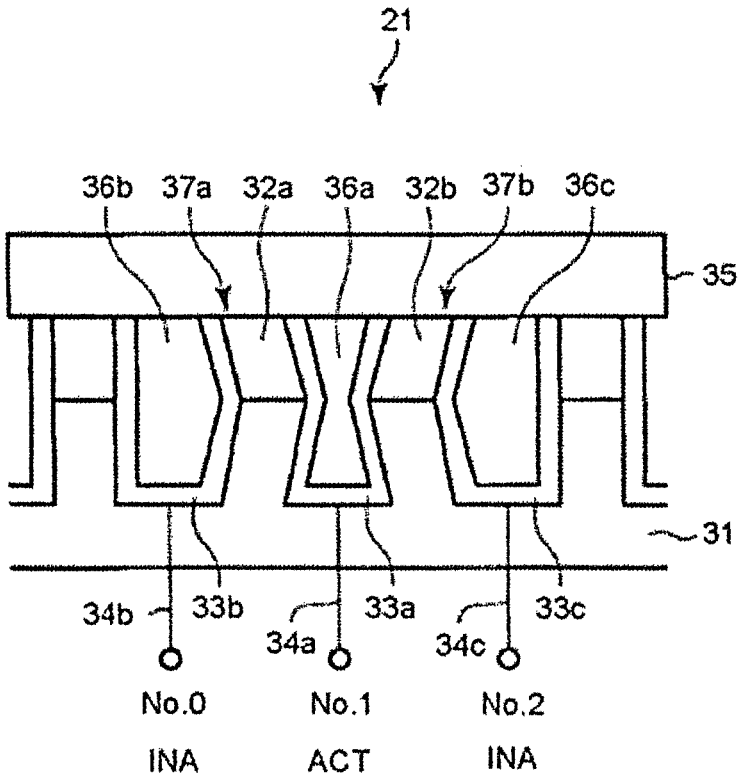
FIG. 4 is a cross-sectional view illustrating a case in which the ejection section is in a cancel state according to the embodiment.

FIG. 4 is a cross-sectional view schematically illustrating the ejection section 21 that is in a cancel state.

After an appropriate time elapses since the ejection operation is completed, the ejection section 21 sets the actuators to the cancel state for canceling the vibration generated in the actuators 37 due to the ejection operation.

In order to enable the actuators to be in the cancel state, the driving circuit 22 applies a voltage to the actuators 37*a* and 37*b* through the electrodes 33*a*~33*c* to drive the actuators. Consequently, the actuators 37*a* and 37*b* deform as shown in FIG. 4.

During the period the voltage is applied to the actuators 37*a* and 37*b*, the actuator 37*a* bends towards the inside of the pressure chamber 36*a* as shown in FIG. 4. Similarly, the actuator 37*b* bends towards the inside of pressure chamber 36*a*. That is, the volume of the pressure chamber 36*a* decreases when compared to the release state (the state shown in FIG. 2). After the cancel state is kept for a while and an appropriate time elapses, the voltage applied to the actuators 37*a* and 37*b* is returned to zero. As a result, the actuators 37*a* and 37*b* return to the state shown in FIG. 2. In this way, the ejection section 21 can suppress the vibration and the like generated in the actuators 37 while ejecting ink.

Next, the driving circuit 22 (driving section) is described.

The driving circuit 22 drives the ejection section 21 to eject ink based on an instruction from the head controller 15. By applying a voltage to the electrodes 33 of the ejection section 21, the driving circuit 22 drives and deforms the actuators 37 of the ejection section 21. By driving the actuators 37, the driving circuit 22 enables the ink to be filled in the ejection section 21 and to be ejected on the printing medium. The driving circuit 22 is electrically connected with the electrode 33 of each channel of the ejection section 21. For example, the driving circuit 22 is constituted by IC.

In the present embodiment, the driving circuit 22 applies a voltage to the actuators 37 of the channels, resulting to eject different amount of ink for different drops.

Figure 5:
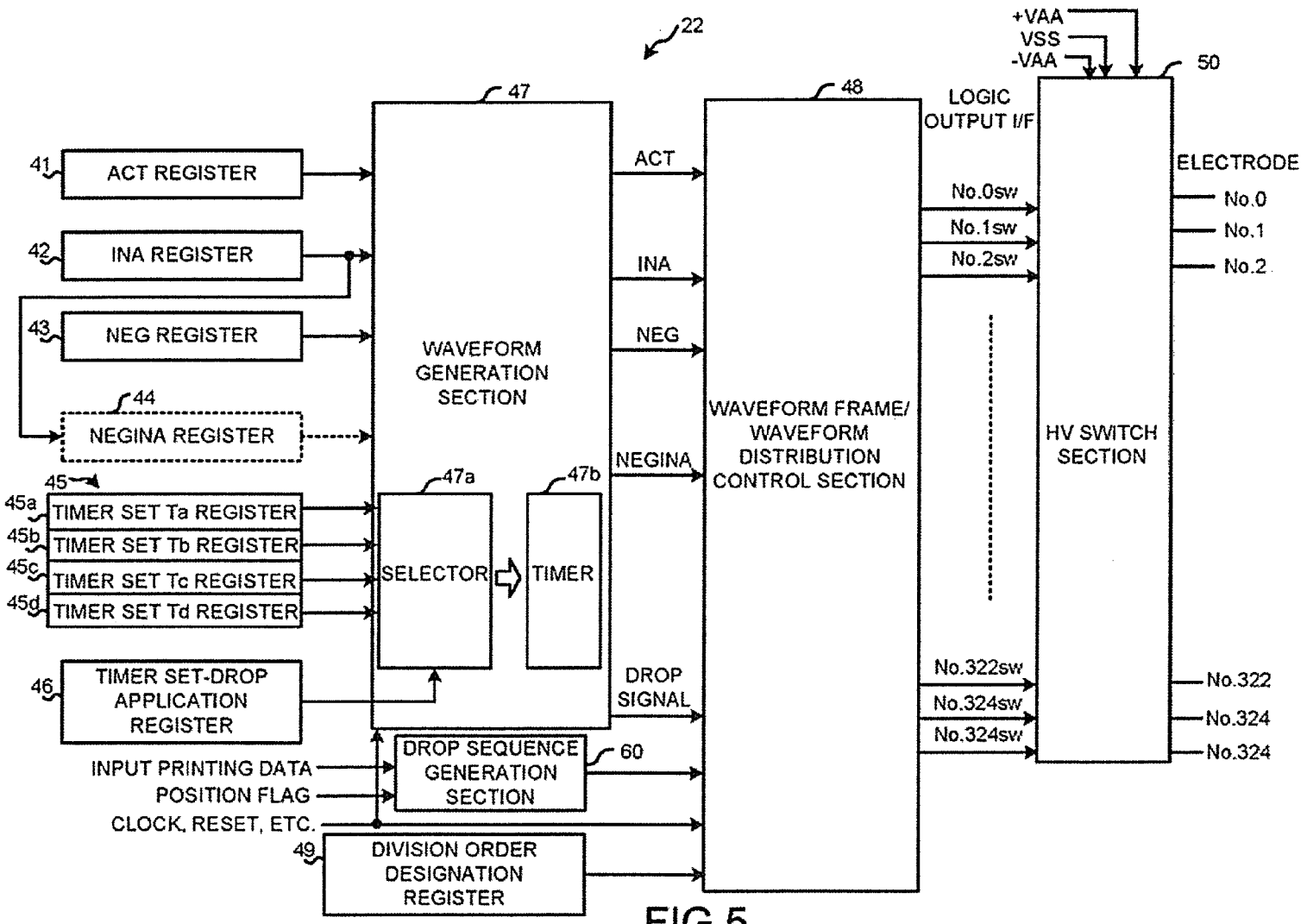
FIG. 5 is a block diagram illustrating an example of constitution of a driving circuit according to the embodiment.

FIG. 5 is a block diagram illustrating an example of constitution of the driving circuit 22.

As shown in FIG. 5, the driving circuit 22 comprises an ACT register 41, an INA register 42, a NEG register 43, a NEGINA register 44, a timer set register 45, a timer set-drop application register 46, a waveform generation section 47, a waveform frame/waveform distribution control section 48, a division order designation register 49, an HV switch section 50, a drop sequence generation section 60 and the like.

The ACT register 41 stores information (pattern) for ejecting ink indicating the voltage levels of waveform segments which is applied to the electrodes of the channels that is capable of ejecting ink (target electrodes, No. 1 channel in FIG. 2). That is, the ACT register 41 determines the voltage levels of the waveform of the ACT voltage. The ACT register 41 stores voltage information indicating a voltage applied during each period of the waveform segments in an associated manner. For example, the ACT register 41 stores "+", "VSS" or "−" as the voltage information corresponding to the period of the waveform segments of ACT voltage. Herein, the "+" represents that +VAA voltage is applied to the target electrodes. The "VSS" represents that a voltage of 0V is applied to the target electrodes. The "−" represents −VAA voltage is applied to the target electrodes.

For example, the ACT register 41 stores "VSS, −, −, +" as the voltage information. In this example, it indicates that the ACT register 41 stores the voltage of 0V applied to the target electrodes in the first period of the ACT voltage, stores −VAA applied to the target electrodes in the second and third periods, and stores +VAA applied to the target electrodes in the fourth period. No limitation is given to the form of the pattern stored in the ACT register 41.

The number of elements stored in the ACT register 41 is determined according to the number of waveform elements of the ACT voltage. Further, the ACT register 41 may be a fixed register where the patterns are written when manufacturing, or a rewritable register. If the ACT register 41 is a rewritable register, the values of the timer set register 45 may be stored through an initial setting from the CPU 11, or may be stored or changed by the CPU 11 at any timing.

The INA register 42 stores a pattern for ejecting ink indicating the voltage levels of waveform segments that is applied to the electrodes of the channels adjacent to the channel capable of ejecting ink (adjacent electrodes, the No. 0 channel, and the No. 2 channel shown in FIG. 2). That is, the INA register 42 determines the voltage levels of the waveform of the INA voltage.

The NEG register 43 stores a pattern of a voltage (NEG voltage) that is applied to the target electrodes in a case of not ejecting ink from the channel that is capable of ejecting ink.

The NEGINA register 44 stores a pattern of a voltage (NEGINA voltage) that is applied to the adjacent electrodes in a case of not ejecting ink from the channel that is capable of ejecting ink. Alternatively, the INA register 42 may be substituted for the NEGINA register 44.

The constitutions of the INA register 42, the NEG register 43 and the NEGINA register 44 are identical to the constitution of the ACT register 41, and therefore the detailed descriptions thereof are not provided.

As stated above, each register described above stores the voltage pattern applied to the electrodes of the actuators.

On the other hand, the timer set register 45 stores a series of time intervals (timer set) of each period of the pattern of voltage. The timer set is constituted by time information indicating time interval of each period. The number of time information stored in the timer set may be identical to or different from the number of segments of the voltage pattern. The timer set register 45 may further store an ending time tdp at which the generation of voltage waveform by the waveform generation section 47 should be ended.

The timer set register 45 may be stored in advance as a non-rewritable and fixed register in the driving circuit 22. Alternatively, the timer set register 45 may be a rewritable register in the driving circuit 22. When the timer set register 45 is a rewritable register, the values of the timer set register 45 may be stored through an initial setting from the CPU 11, or may be stored or changed by the CPU 11 at any timing.

In the example shown in FIG. 5, the timer set register 45 has plural timer sets. The timer set register 45 consists of a timer set Ta register 45*a*, a timer set Tb register 45*b*, a timer set Tc register 45*c* and a timer set Td register 45*d*.

The timer set Ta register 45*a* stores a timer set Ta.

The timer set Tb register 45*b* stores a timer set Tb which is different from the timer set Ta. The timer set Tc register 45*c* stores a timer set Tc which is different from both the timer set Ta and the timer set Tb. The timer set Td register 45*d* stores a timer set Td which is different from each of the timer sets Ta~Tc.

FIG. 6 is a diagram illustrating an example of constitution of the timer sets Ta~Td.

In one embodiment, each timer set stores t0~t10 as the time information as shown in FIG. 6(*a*). The time information of a timer set indicates time intervals of the waveform segments. Further, the order of the time information corresponds to the order of the waveform segments.

For example, the timer set Ta register 45*a* stores "t0*a*, t1*a*, t2*a*, t3*a* . . . " as the timer set Ta. For example, the timer set Ta register 45*a* indicates that the first period is "t0*a*".

In another embodiment, as shown in FIG. 6(*b*), each timer set stores the time information indicating time intervals and the ending time tdp at which the generation of voltage waveform by the waveform generation section 47 is ended. The time information "t0*a*, t1*a*, t2*a*, t3*a* . . . , t9*a*" is identical to the time information shown in FIG. 6(*a*).

The ending time tdp may be longer than or shorter than a sum of the time intervals indicated by corresponding time information. In a case in which the ending time tdp is longer than the sum of time intervals, the waveform generation section 47 applies a voltage of 0V to both the electrode of the target channel and the electrodes of the adjacent channels after the time interval indicated by the final time information elapses.

Each timer set of Ta~Td may store the different ending time tdp respectively, or store the identical ending time tdp.

In a case in which the timer set stores the ending time tdp, the waveform generation section 47 ends the generation of waveform for an ejection operation of one ink droplet at the ending time tdp. This is an end of a drop frame. Then the waveform generation section 47 starts generation of waveform for next drop frame, for an ejection operation of next ink droplet if it exists. Here, "drop frame" is a time frame prepared for one ink droplet to be ejected.

Further, the timer set register 45 may store not only the timer set including the ending time tdp but also the time set not including the ending time tdp.

The timer set-drop application register 46 sends a selection signal for designating a timer set to be selected by a selector 47*a* to the selector 47*a*. The selection signal indicates the timer set selected by the selector 47*a*. That is, the selector 47*a* selects a timer set based on the selection signal sent by the timer set-drop application register 46.

The timer set-drop application register 46 sends a selection signal every time the waveform generation section 47 generates a waveform, that is, the timer set-drop application register 46 sends a selection signal on each drop frame. Alternative structure is that the timer set-drop application register 46 sends all of the selection signals corresponding to every drop frames to the selector 47*a* simultaneously, and the selector 47*a* selects the selection signal on each drop frame in order.

FIG. 7 is an example of a timer set selection table stored in the timer set-drop application register 46. The timer set selection table stores the drop frame number and the timer set in an associated manner.

The timer set-drop application register 46 sends the selection signal to the selector 47*a* based on the timer set selection table. That is, the timer set-drop application register 46 sends a selection signal for selecting a timer set corresponding to the drop frame number to the selector 47*a*.

For example, the timer set-drop application register 46 sends a selection signal used for selecting the timer set Ta as the timer set of the first drop frame of ink to the selector 47*a*.

Every time just after the waveform generation section 47 generates a waveform corresponding to one drop of ink, the timer set-drop application register 46 sends a selection signal corresponding to the next drop of ink to the selector 47*a*. In the alternative structure mentioned above, the timer set-drop application register 46 sends the selection signals corresponding to all drops of ink to the selector 47*a*, before the waveform generation section 47 generates the waveform corresponding to the drops of ink.

The waveform generation section 47 generates a waveform of voltage applied to the ejection section 21 based on the selection signal sent by each of the ACT register 41, the INA register 42, the NEG register 43, the NEGINA register 44, the timer set Ta register 45*a*, the timer set Tb register 45*b*, the timer set Tc register 45*c*, the timer set Td register 45*d* and the timer set-drop application register 46. The waveform generation section 47 generates a waveform of voltage by combining the pattern with the timer set.

For example, in a case of generating the waveform of ACT voltage, the waveform generation section 47 combines a pattern stored in the ACT register 41 with a timer set (for example, the timer set Ta) to generate the waveform of ACT voltage. In this case, the waveform generation section 47 sets the time of the first period of the voltage waveform to "t0*a*" based on the timer set Ta. Further, the waveform generation section 47 sets the voltage in the first period of the ACT voltage to be "VSS" based on the information stored in the ACT register 41. The waveform generation section 47 carries out the same operations in all periods to generate the waveform of the ACT voltage.

As shown in FIG. 5, the waveform generation section 47 is provided with the selector 47*a* and a timer 47*b*.

The selector 47*a* selects a timer set from a plurality of timer sets (the timer sets Ta, Tb, Tc and Td in FIG. 5) which is used to generate a voltage waveform. The selector 47*a* selects a timer set for each drop frame. For example, the selector 47*a* selects the timer set Ta for the first and the second drop frame, and selects the timer set Tb for the third and the fourth drop frame. The selector 47*a* selects the timer sets for the purpose of that the volume of the ejected ink becomes a predetermined volume. For example, the selector 47*a* selects the timer sets Ta for the drop volume of 5.5 pl ejected at first and the second drop frame, and selects the timer sets Tb for the drop volume of 6 pl ejected at third and the fourth drop frame.

The selector 47*a* sends the selected timer sets to the timer 47*b*.

The timer 47*b* sets the length of each period of each voltage segment based on the timer sets selected by the selector 47*a*. The timer 47*b* informs whole of the waveform generation section 47 about the end of the segment using a signal at the end of each period.

Further, in a case in which the timer set selected by the selector 47*a* stores an ending time tdp, the timer 47*b* sets the ending time tdp. In this case, for example, the timer 47*b* measures the time after the ejection operation is started. When the measured time reaches the ending time tdp, the timer 47*b* issues a signal to inform whole of the waveform generation section 47 that the ending time elapses.

The waveform generation section 47 generates a voltage waveform based on the length of each period set by the timer 47*b* and the voltage pattern, and sends the generated waveform to the waveform frame/waveform distribution control section 48.

For generating a waveform of the ACT voltage, the waveform generation section 47 acquires information indicating the voltage of the first period from the ACT register 41. Then, the waveform generation section 47 sends an instruction to apply the voltage indicated by the acquired information to the waveform frame/waveform distribution control section 48. When the timer 47*b* informs the ending of the first period, the waveform generation section 47 acquires information indicating the voltage of the second period. Then, the waveform generation section 47 sends an instruction to apply the voltage indicated by the acquired information to the waveform frame/waveform distribution control section 48. The waveform generation section 47 carries out the same operations for all periods to generate the waveform of the ACT voltage.

Through the operations similar to that described above, the waveform generation section 47 generates a waveform of the INA voltage, a waveform of the NEG voltage and a waveform of the NEGINA voltage.

For the same drop frame, the waveform generation section 47 applies a same timer set for any one of voltage waveforms. For example, for the first drop frame, the waveform generation section 47 applies the timer set Ta including t0*a*, t1*a*, t2*a*, . . . for any one of the voltage waveforms. Further, for the second drop frame, the waveform generation section 47 applies the timer set Tb for any one of the voltage waveforms.

The waveform frame/waveform distribution control section 48 generates a switch control signal used to apply a voltage to the electrodes of each channel. The waveform frame/waveform distribution control section 48 generates a switch control signal for applying the ACT voltage or the NEG voltage as the switch control signal of a group (target division) of channels capable of ejecting ink simultaneously. Further, the waveform frame/waveform distribution control section 48 generates a switch control signal for applying the INA voltage or the NEGINA voltage as the switch control signal of a group (adjacent division) of channels adjacent to the channels capable of ejecting ink.

The division order designation register 49 stores an order for setting the group capable of ejecting ink.

The waveform frame/waveform distribution control section 48 and the division order designation register 49 are described in detail later.

The HV switch section 50 applies a voltage to the actuators 37 of each channel based on the switch control signal from the waveform frame/waveform distribution control section 48.

The HV switch section 50 is described in detail later.

The drop sequence generation section 60 generates a drop sequence based on the printing data and the position flag sent by the CPU 11 through the head controller 15.

The printing data designates the times of ejecting ink for each channel. For example, the printing data may be represented by code data (e.g. the coded data representing the number of drops). Further, the printing data may indicate the times of ejecting ink by the channels with a sequence of 1/0 signals (binary signal).

The position flag designates a timing at which a channel starts to eject ink. The position flag designates a drop frame number of which the drop starting to be ejected. For example, in a case in which the position flag indicates "4", the channel starts to eject ink from the fourth drop frame.

The drop sequence indicates the times and the timing of ejecting ink from the channel with 1/0 signals (binary signal) "1" represents ejection of ink, and "0" represents no ejection of ink. The drop sequence stores the 1/0 signals of the number which is as same as the number of times the channel can eject ink droplet continuously.

The drop sequence generation section 60 generates a drop sequence in such a manner that the channel starts to eject ink droplet from the drop frame number indicated by the position flag and continue to eject ink droplets of the number which is indicated by the printing data.

The drop sequence generation section 60 sends the generated drop sequence to the waveform frame/waveform distribution control section 48.

FIG. 8 is an example of the constitutions of the printing data, the drop sequence and the number of drop.

It is assumed herein that the position flag is indicated by "4". Further, in the drop sequence, "1" indicates the ejection of ink, and "0" indicates no ejection of ink.

Furthermore, it is also assumed that each channel can eject ink 7 times continuously. Thus, the printing data is constituted by 3-bit code data.

As shown in FIG. 8, the drop sequence is constituted in such a manner that the channel starts to eject ink from the fourth drop frame. For example, the drop sequence corresponding to the printing data "010" is constituted in such a manner that the channel ejects ink twice from the fourth drop frame.

FIG. 9 is an example of the constitutions of the position flag and the drop sequence.

It is assumed that the printing data is "011". That is, the number of drop is 3.

As shown in FIG. 9, the drop sequence is constituted in such a manner that the channel starts to eject ink from the drop frame number indicated by the position flag. For example, the drop sequence corresponding to the position flag "2" is constituted in such a manner that the channel ejects ink three times from the second drop.

As stated above, instead of generating the drop sequence through the printing data and the position flag, the drop sequence can be supplied directly from the head controller 15 to the driving circuit 22 without equipping with the drop sequence generation section.

Figure 10:
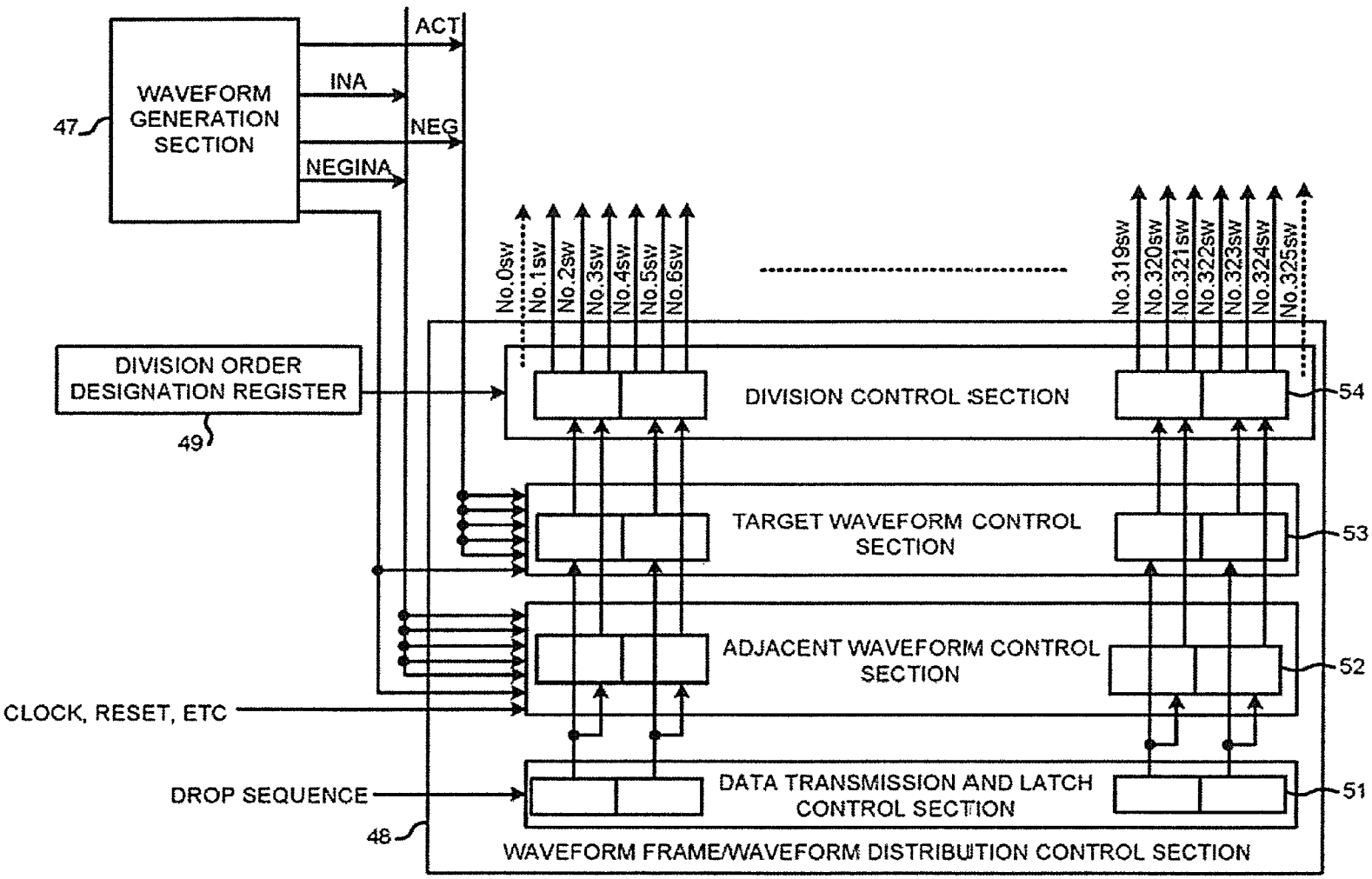
FIG. 10 is a block diagram illustrating an example of constitution of waveform frame/waveform distribution control section according to the embodiment.

FIG. 10 is a block diagram illustrating an example of the constitution of the waveform frame/waveform distribution control section 48.

As shown in FIG. 10, the waveform frame/waveform distribution control section 48 comprises a data transmission and latch control section 51, an adjacent waveform control section 52, a target waveform control section 53 and a division control section 54.

The data transmission and latch control section 51 acquires the drop sequence.

The data transmission and latch control section 51 transmits the timings when the channels eject ink to the adjacent waveform control section 52 and the target waveform control section 53 based on the drop sequence.

Based on the timings when the channels eject ink, the adjacent waveform control section 52 sets a waveform of the voltage applied to the electrodes 33 of the channels (adjacent channels) adjacent to the channel (target channel) capable of ejecting ink. For example, the adjacent waveform control section 52 sets an INA voltage waveform or a NEGINA voltage waveform as the waveform of voltage which is applied to the adjacent channels. In a case in which the target channel ejects ink, the adjacent waveform control section 52 sets the INA voltage waveform as the waveform of voltage which is applied to the adjacent channels adjacent to the target channel. Further, in a case in which the target channel doesn't eject ink, the adjacent waveform control section 52 sets the NEGINA voltage waveform as the waveform of voltage which is applied to the adjacent channels adjacent to the target channel.

Based on the timings when the channels eject ink, the target waveform control section 53 sets a waveform of the voltage applied to the electrodes 33 of the channel capable of ejecting ink. For example, the target waveform control section 53 sets an ACT voltage waveform or a NEG voltage waveform as the waveform of voltage which is applied to the target channel. In a case in which the target channel ejects ink, the target waveform control section 53 sets the ACT voltage waveform as the waveform of voltage which is applied to the target channel. In a case in which the target channel doesn't eject ink, the target waveform control section 53 sets the NEG voltage waveform as the waveform of voltage which is applied to the target channel.

The division control section 54 sets a target channel group (target division) and an adjacent channel group (adjacent division) based on the division order stored in the division order designation register 49. The division control section 54 sends a switch control signal based on the waveform set by the target waveform control section 53 to the HV switch section 50 as a switch control signal corresponding to the channel of the target division. Further, the division control section 54 sends a switch control signal based on the waveform set by the adjacent waveform control section 52 to the HV switch section 50 as a switch control signal corresponding to the channel of the adjacent division.

The division order designation register 49 stores the order for setting the group of channels capable of ejecting ink. For example, the division order designation register 49 may store information indicating that, first a group of channels having No. 3n+1 (n represents natural number including 0) is set as the target division, next a group of channels having No. 3n+2 is set as the target division, and finally a group of channels having No. 3n+3 is set as the target division.

In this example, the division control section 54 firstly sets the group of channels having No. 3n+1 (first division) as the target division. At this time, the division control section 54 sets the group of channels having No. 3n+2 and the group of channels having No. 3n+3 as the adjacent division.

After the ejection operation of the target division is ended, the division control section 54 sets the group of channels having No. 3n+2 (second division) as the target division. At this time, the division control section 54 sets the group of channels having No. 3n+1 and the group of channels having No. 3n+3 as the adjacent division.

After the ejection operation of the target division is ended, the division control section 54 sets the group of channels having No. 3n+3 (third division) as the target division. At this time, the division control section 54 sets the group of channels having No. 3n+1 and the group of channels having No. 3n+2 as the adjacent division.

With the operations described above, the division control section 54 can control to eject ink from all channels.

Figure 11:
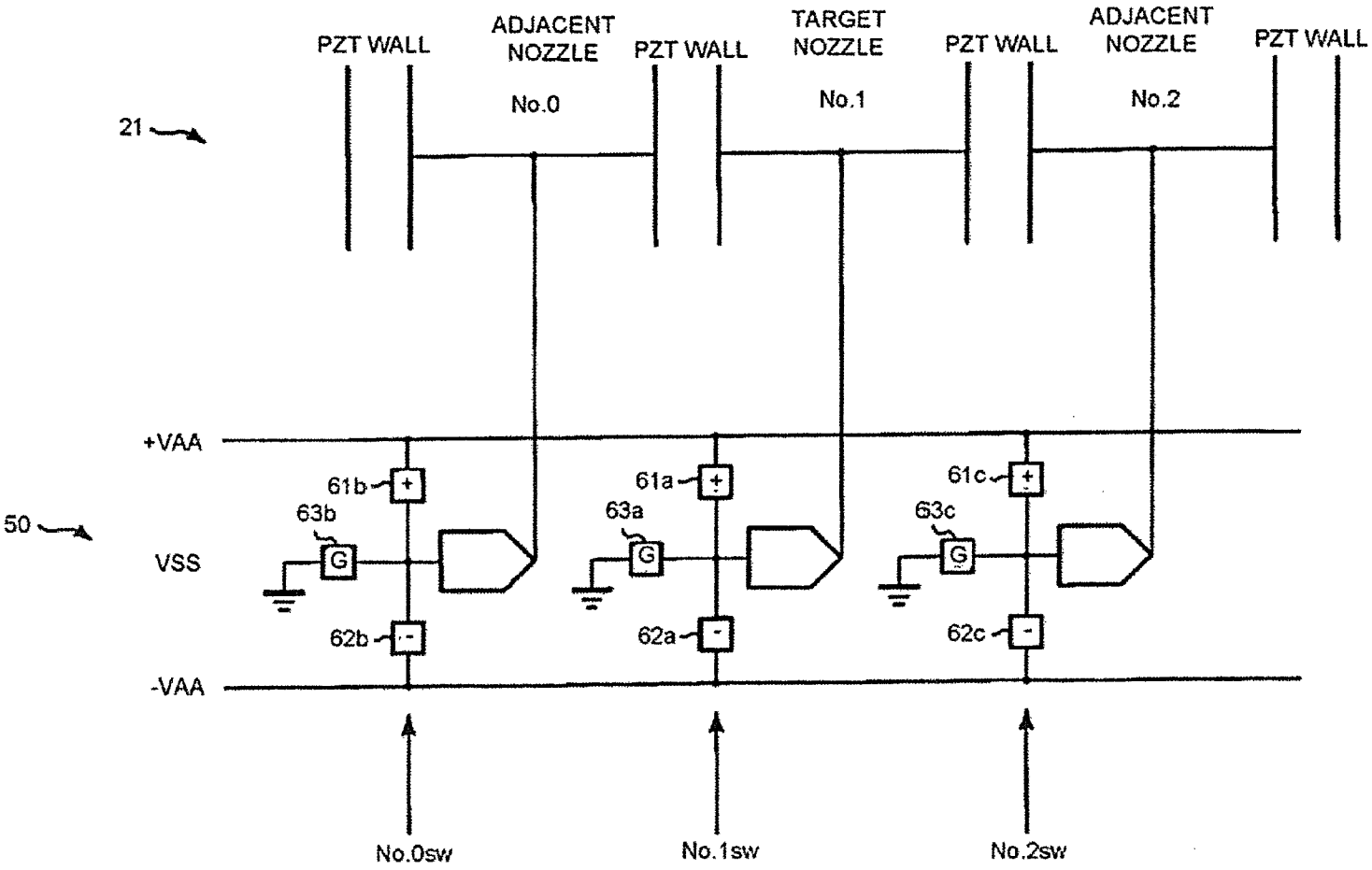
FIG. 11 is a diagram schematically illustrating an example of constitution of an HV switch section and the ejection section according to the embodiment.

FIG. 11 is a block diagram illustrating an example of constitution of the HV switch section 50 (voltage applying section).

As shown in FIG. 11, the HV switch section 50 comprises a +VAA switch 61, a −VAA switch 62 and a VSS switch 63.

The +VAA switch 61 is a switch connecting the +VAA as a positive voltage supply with the electrodes 33 of a channel.

The −VAA switch 62 is a switch connecting the −VAA as a negative voltage supply with the electrodes 33 of a channel.

The VSS switch 63 is a switch connecting the VSS (ground) with the electrodes 33 of a channel.

The three switches operate exclusively. That is, if one of the three switches is connected with the electrodes 33, the left two switches never connect with the electrodes 33.

For example, the +VAA switch 61, the −VAA switch 62 and the VSS switch 63 are constituted with an MOS transistor and the like.

In the present embodiment, the range of the +VAA is +7V~+18V. Further, the range of the −VAA is −7V~−18V. Neither the +VAA nor the −VAA is limited to a specific voltage.

Herein, the HV switch section 50 comprises the +VAA switch 61*b*, the −VAA switch 62*b* and the VSS switch 63*b* as the switches corresponding to the No. 0 channel. Further, the HV switch section 50 comprises the +VAA switch 61*a*, the −VAA switch 62*a* and the VSS switch 63*a* as the switches corresponding to the No. 1 channel. The HV switch section 50 also comprises the +VAA switch 61*c*, the −VAA switch 62*c* and the VSS switch 63*c* as the switches corresponding to the No. 2 channel.

For example, when receiving a signal connecting with the "+VAA" as a switch control signal on the No. 1 channel, the HV switch section 50 turns off the −VAA switch 62*a* and the VSS switch 63*a*, and turns on the +VAA switch 61*a*. Through this operation, the HV switch section 50 applies +VAA to the electrodes 33 of the No. 1 channel.

Next, the voltage applied to the actuators 37 is described.

Figure 12:
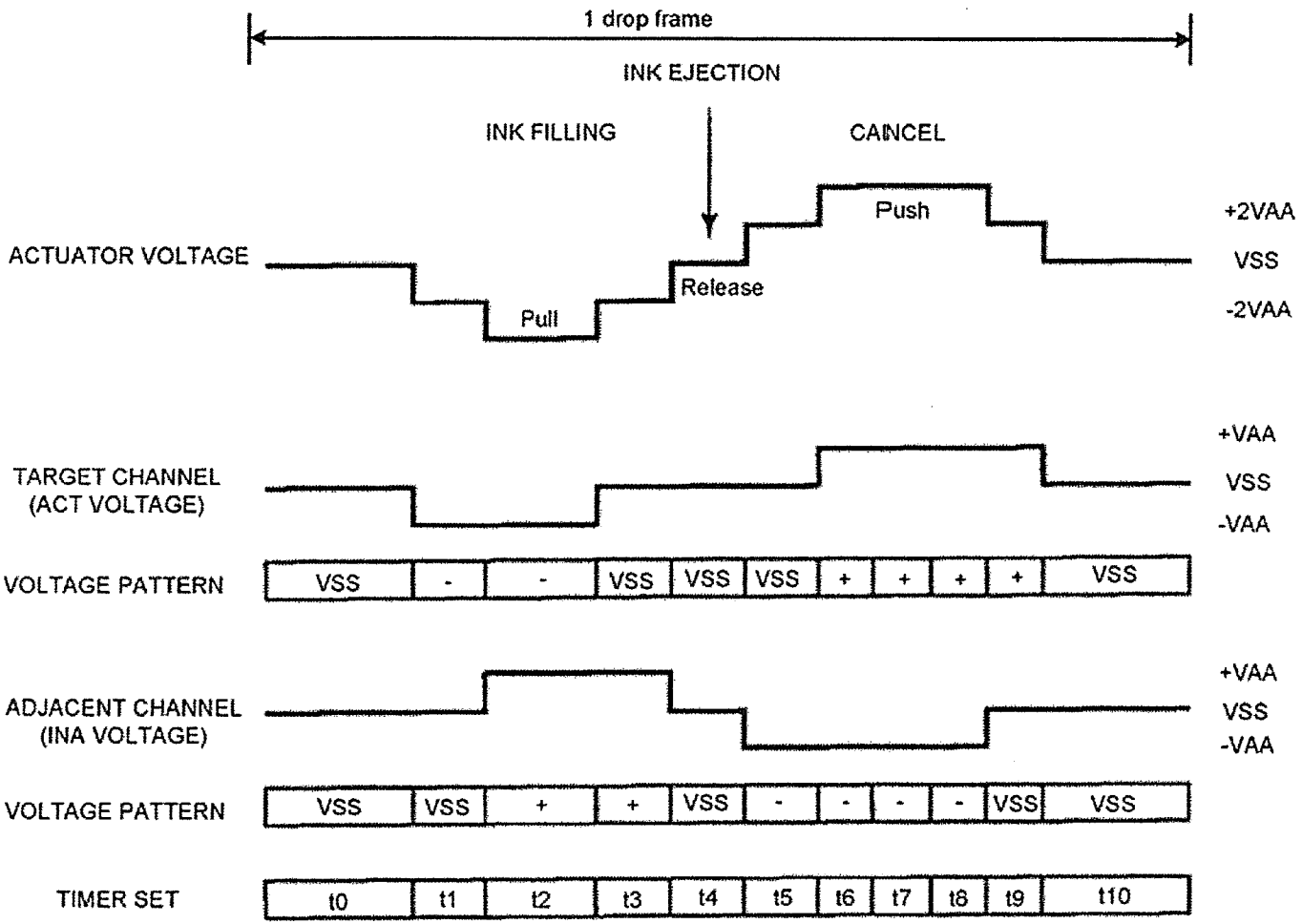
FIG. 12 is a timing chart illustrating the voltage that is applied to an actuator of the ejection section according to the embodiment.

FIG. 12 is a timing chart indicating the voltage applied to the actuators 37, the ACT voltage and the INA voltage.

The timing chart shown in FIG. 12 represents each voltage when the target channel ejects one ink droplet at one drop frame.

An actuator voltage represents a voltage applied to the actuators 37 of the target channel. In the example shown in FIG. 2, when the target channel is the No. 1 channel, the actuator voltage is the voltage applied to the actuator 37*a* and the actuator 37*b*. A polarity of the voltage applied to the actuators 37 is defined to be positive if the voltage of electrode 33 of the target channel is positive relative to the opposite side of the actuator 37, and defined to be negative if the voltage of electrode 33 of the target channel is negative relative of the opposite side of the actuator 37.

As shown in FIG. 12, first, a negative voltage is applied to the actuator 37*a* and the actuator 37*b*. When the negative voltage is applied, the actuator 37*a* and the actuator 37*b* become the PULL state shown in FIG. 3. At this time, the pressure chamber 36*a* attracts ink from the ink tank.

Then a voltage of 0V is applied to the actuator 37*a* and the actuator 37*b*. When the voltage of 0V is applied, the actuator 37*a* and the actuator 37*b* become the release state shown in FIG. 2. At this time, the ink is ejected from the pressure chamber 36*a* on the printing medium.

Then a positive voltage is applied to the actuator 37*a* and the actuator 37*b*. At this time, the actuator 37*a* and the actuator 37*b* become the cancel state shown in FIG. 4. Then, a voltage of 0V is applied to the actuator 37*a* and the actuator 37*b*. At this time, the ejection operation of one ink droplet is ended.

The ACT voltage applied to the electrode 33*a* is generated with the pattern of the ACT voltage and the timer set. In the example in FIG. 12, the pattern of ACT voltage in the first period is "VSS". Further, the timer set indicates that the first period has a time length of "t0". Thus, the first period of the ACT voltage is the t0 time, and the ACT voltage in the first period is "0".

Similarly, the pattern of ACT voltage in the second period is "–". Further, the timer set indicates that the second period has a time length of "t1". Thus, the second period of the ACT voltage is the t1 time, and the ACT voltage during the second period is "–VAA".

Similarly, in each period of the ACT voltage segment, the length and the voltage thereof are determined.

The INA voltage is also generated similarly. The voltage applied to the actuators 37 is the difference of voltage between the ACT voltage and the INA voltage.

If the polarization direction of a first piezoelectric member 31 and second piezoelectric members 32*a* is opposite to this embodiment, the polarity of the voltage applied to the electrodes 33 should be the opposite polarity.

Figure 13:
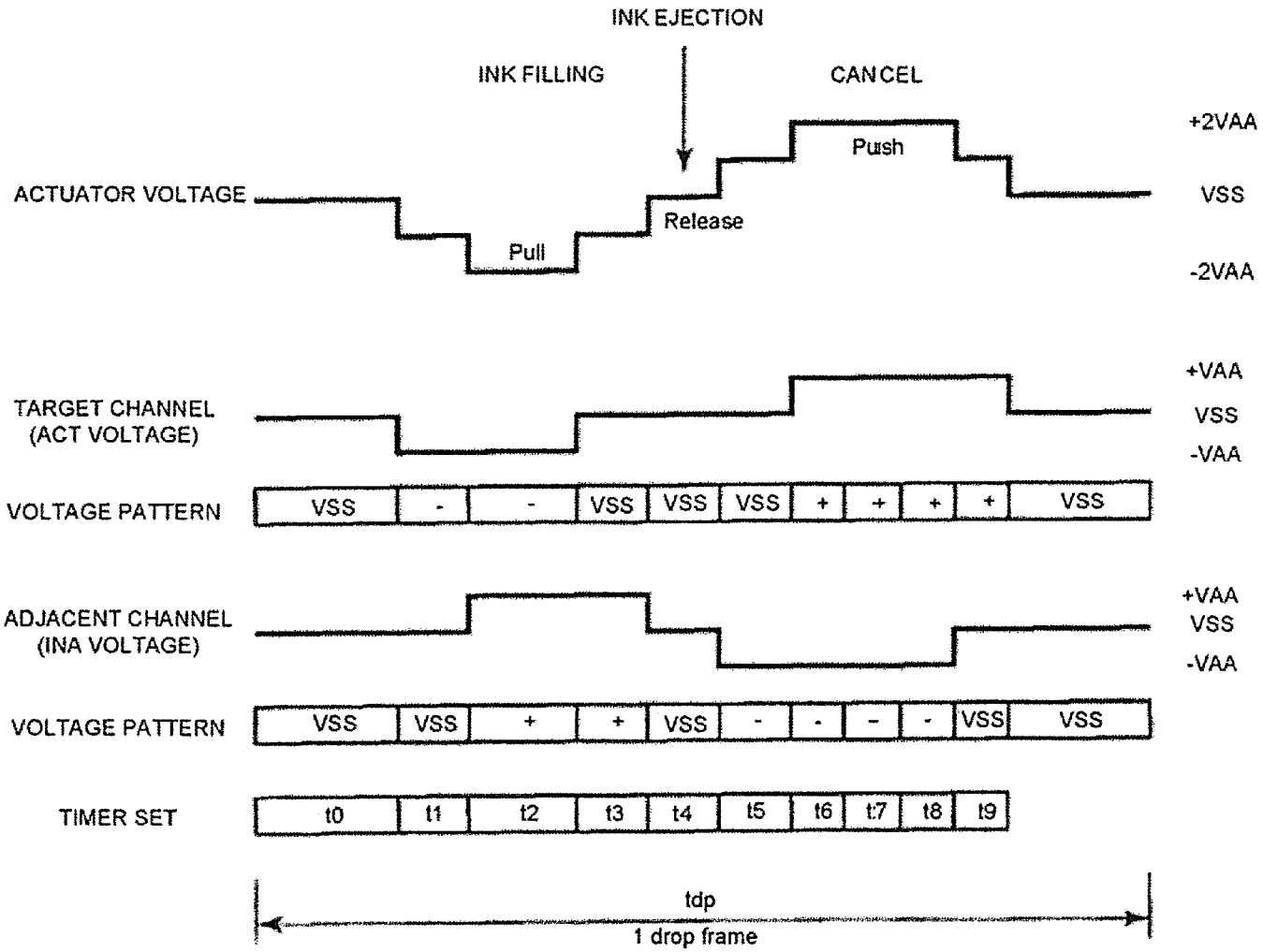
FIG. 13 is another timing illustrating the voltage that is applied to the actuator of the ejection section according to the embodiment.

FIG. 13 is another timing chart illustrating the voltage applied to the actuators 37, the ACT voltage and the INA voltage.

In the example shown in FIG. 13, the timer set doesn't contain t10 but contains the ending time tdp. Further, sum of the time from t0 to t9 stored in the timer set is shorter than the ending time tdp.

As shown in FIG. 13, the "VSS" state in the 11th period of the ACT voltage lasts until the ending time tdp. Similarly, the "VSS" state in the 11th period of the INA voltage lasts until the ending time tdp.

Figure 14:
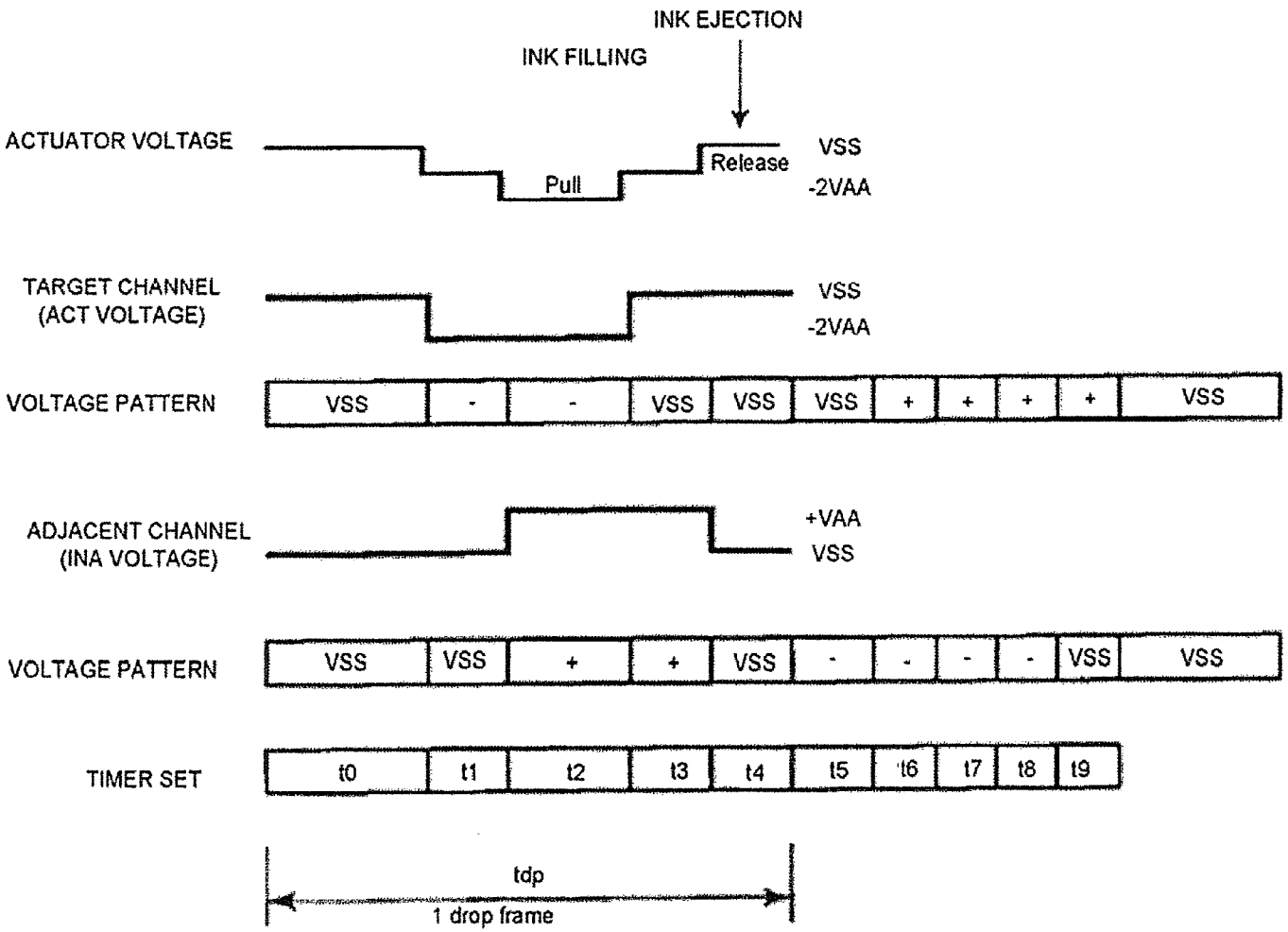
FIG. 14 is still another timing chart illustrating the voltage that is applied to the actuator of the ejection section according to the embodiment.

FIG. 14 is another timing chart illustrating the voltage applied to the actuators 37, the ACT voltage and the INA voltage.

In the example shown in FIG. 14, the timer set doesn't contain t10 but contains the ending time tdp. Further, sum of the time from t0 to t9 stored in the timer set is longer than the ending time tdp.

As shown in FIG. 14, the driving circuit 22 generates the ACT voltage and the INA voltage until the ending time tdp, and won't generate a new ACT voltage and a new INA voltage after the ending time tdp. When the ending time tdp elapses, the driving circuit 22 ends the ejection operation of one drop of ink.

In this way, by setting the ending time tdp, it is possible to select to execute all the voltage patterns in each register in which the voltage patterns of the ACT voltage and the INA voltage are stored, or to execute part of voltage patterns. That is, as shown in FIG. 13, all the voltage patterns are executed and the ejection operation is carried out if the ending time tdp is set to be longer than the time t0~t9, and then the actuators 37 become the cancel state; as shown in FIG. 14, if the ending time tdp is set to be shorter than the time t0~t9 and execution of voltage patterns is stayed en route, only the ejection operation is executed and the cancel pulse for setting the actuators to the state shown in FIG. 4 is not provided.

Thus altering the value of the ending time tdp on each drop frame, it is possible to generate waveform for each ink droplet selecting whether or not there is a cancel pulse according to the drop number, while sharing the voltage pattern stored in ACT register 41 and INA register 42.

For example, it is also possible to generate waveform in a manner that the cancel pulse is omitted for the first ink droplet as the vibration of the ink pressure in the pressure chamber is relatively small because of the influence of the ink thixotropic properties and the hysteresis of the actuator, and the cancel pulse is added for the later droplets. In this way, the time required to eject the first droplet can be saved, and it is possible to print with high speed correspondingly.

Figure 15:
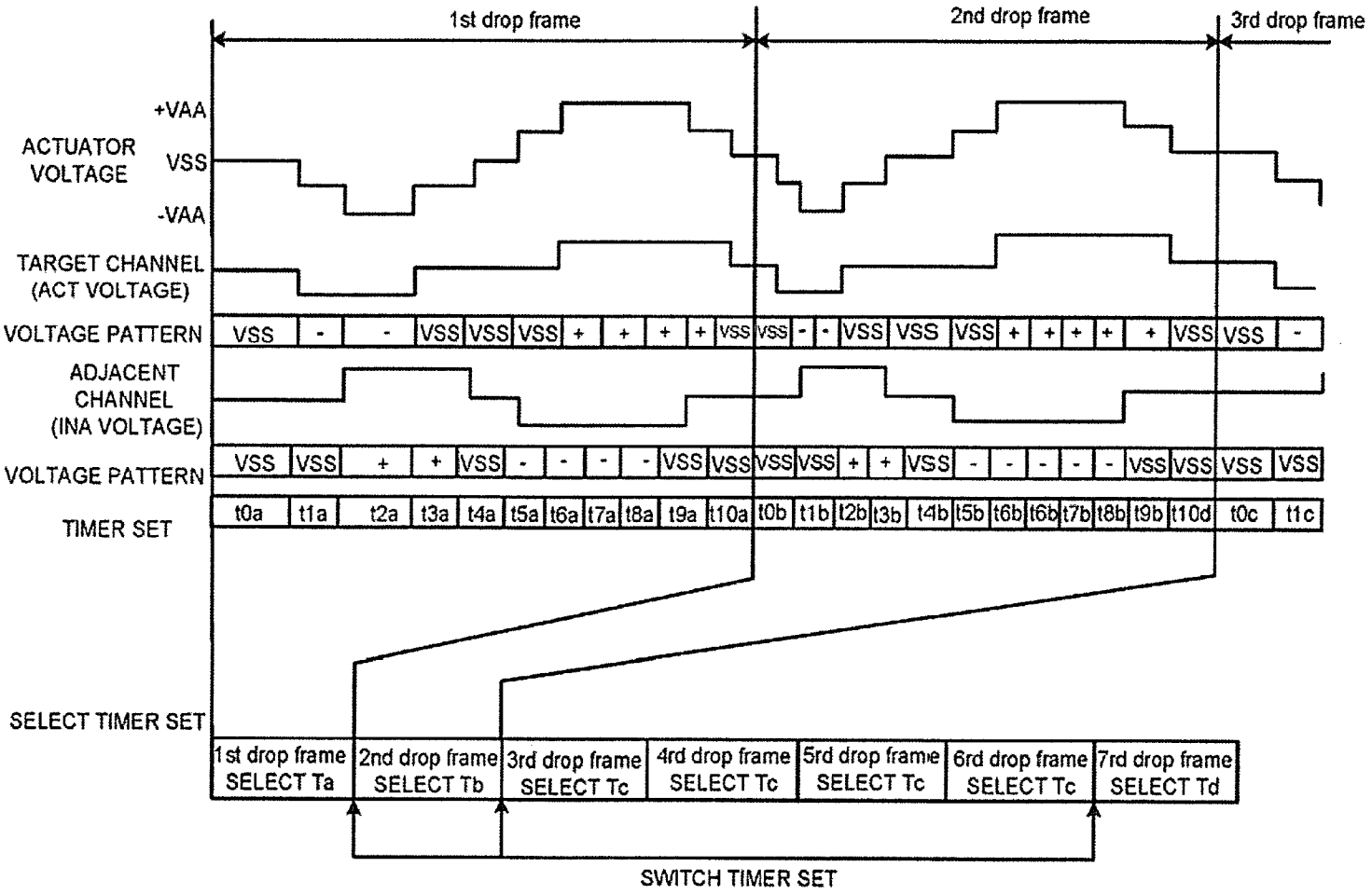
FIG. 15 is a timing chart illustrating the voltages corresponding to multiple ink drops that are applied to the actuator of the ejection section according to the embodiment.

FIG. 15 is a timing chart illustrating the voltage applied to one actuator 37, the ACT voltage and the INA voltage in the ejection operation of seven drops of ink.

Herein, the timer set-drop application register 46 stores the timer set Ta as the timer set of the first drop, stores the timer set Tb as the timer set of the second drop, stores the timer set Tc as the timer set of the third drop to sixth drop, and stores the timer set Td as the timer set of the seventh drop.

Next, an operation example of the inkjet head 18 is described. Herein, the operation example of the inkjet head 18 is described according to the timing chart shown in FIG. 15.

First, the CPU 11 starts printing based on an instruction from an external device. If the printing is started, the CPU 11 conveys a paper to positions where the inkjet head 18 ejects ink with the conveyance motor 19.

Then, the selector 47*a* of the waveform generation section 47 selects the timer set Ta as the timer set of the first drop according to the selection signal sent by the timer set-drop application register 46. If the selector 47*a* selects the timer set Ta, the timer 47*b* sets the length of each period of the waveform segment according to the timer set Ta. According to the length of each period set by the timer 47*b*, the waveform generation section 47 generates the waveforms of the ACT voltage, the INA voltage, the NEG voltage and the NEGINA voltage. The waveform generation section 47 sends the information indicating the generated waveforms of the voltages to the waveform frame/waveform distribution control section 48.

The target waveform control section 53 of the waveform frame/waveform distribution control section 48 sets the ACT voltage waveform and the NEG voltage waveform based on the information indicating the ACT voltage waveform and the NEG voltage waveform. The adjacent waveform control section 52 of the waveform frame/waveform distribution control section 48 sets the INA voltage waveform and the NEGINA voltage waveform based on the information indicating the INA voltage waveform and the NEGINA voltage waveform.

Further, the drop sequence generation section 60 receives the printing data and the position flag from the CPU 11. If receiving the printing data and the position flag, the drop sequence generation section 60 generates a drop sequence based on the printing data and the position flag. After the drop sequence is generated, the drop sequence generation section 60 sends the generated drop sequence to the data transmission and latch control section 51.

The data transmission and latch control section 51 receives the drop sequence from the drop sequence generation section 60.

The division control section 54 sends a switch control signal based on the ACT voltage waveform and the NEG voltage waveform which are set by the target waveform control section 53 and the drop sequence, as a switch control signal corresponding to the channels of the target division to the HV switch section 50. Further, the division control section 54 sends a switch control signal based on the INA voltage waveform and the NEGINA voltage waveform which are set by the adjacent waveform control section 52 and the drop sequence, as a switch control signal corresponding to the channels of the adjacent division to the HV switch section 50.

The HV switch section 50 receives the switch control signal corresponding to each channel from the division control section 54. Upon receiving the switch control signal corresponding to each channel, the HV switch section 50 applies a voltage to the actuators 37 of each channel according to the switch control signal corresponding to each channel.

With the operations described above, the target channel can eject ink from the pressure chamber 36 on the printing medium. In the example shown in FIG. 15, after the ejection operation of the first drop frame is ended, the selector 47*a* selects the timer set Tb as the timer set of the second drop frame according to the information stored in the timer set-drop application register 46. Then the inkjet head 18 carries out same operations as described above but using time periods of timer set Tb.

After the ejection operations of two drops are ended, the selector 47*a* selects the timer set Tc as the timer set of the third drop according to the information stored in the timer set-drop application register 46. Then the inkjet head 18 carries out same operations as described above for all the drops.

If the same operations are carried out on all drops, the inkjet head 18 ends the ejection operations of the target division. After the ejection operations of the target division are ended, the inkjet head 18 changes the setting of the target division to carry out the same operations. After the inkjet head 18 ends the ejection operations of all channels, the CPU 11 enables the paper to move through the conveyance motor 19 in such a manner that the inkjet head 18 can eject ink to the next printing position. Every time the CPU 11 controls to move the paper, the inkjet head 18 carries out the ejection operation similarly. When the inkjet head 18 ends the ejection operations at all printing positions, the CPU 11 ends the printing.

It can be set freely that which one of the timer sets Ta~Td is used for which one drop according to the information stored in the timer set-drop application register 46.

Further, the CPU 11 moves the inkjet head 18 with the carriage motor 20.

The driving circuit 22 may select the initial timer set during the movement of the paper.

Next, the volume of ink ejected by the channels is described.

The channels eject ink of different volume according to the drop frame number. The volume of ejected ink for each droplet is adjusted by the content of each timer set stored in the timer set register 45, the ending time stored in the timer set-drop application register 46 and the timer set selected by the selector 47*a*. The timer set and the ending time are determined in such a manner that a channel ejects a given amount of ink for a predetermined drop number. Further, the selector 47*a* selects a timer set in such a manner that a channel ejects a given amount of ink for a predetermined drop frame number.

The ink volume to be ejected at each drop frame may increase with the drop frame number, and may decrease with the drop frame number. The constitution of the volume to be ejected at each drop frame is not limited to a specific constitution.

For example, the adjustment of volume may be realized by increasing and decreasing the time t2 in the timer set in FIG. 12. The time t1, t2 and t3 in FIG. 12 determine the time for increasing the volume of the pressure chamber like shown in FIG. 3 and filling the pressure chamber with ink from the ink supply port. The maximum time capable of being used to fill ink is ½ of the natural vibration period of ink in the pressure chamber. The ½ of the natural vibration period of ink in the pressure chamber is set as a reference, and if the time used to increase the volume of the pressure chamber is reduced to be shorter than the reference, the filling amount of ink to the pressure chamber before the ejection operation is reduced, and thus the ejection amount also reduces. If the time adjustment can be carried out with the time t2, it is possible to adjust the ejection volume. By setting different values of the time t2 for different timer sets, it is possible to change the timer set to eject different volume of ink.

Figure 16:
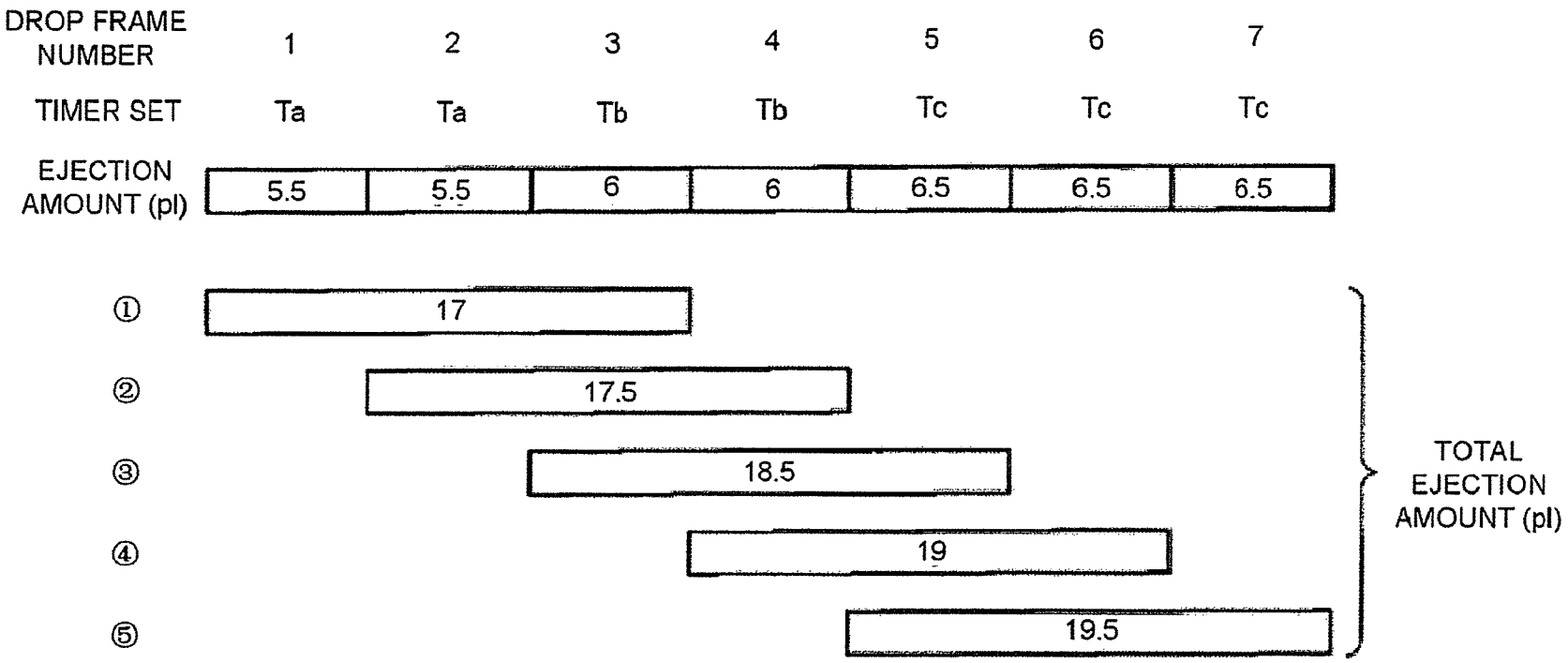
FIG. 16 is a timing chart illustrating the amount of ink ejected by the ejection section according to the embodiment.

FIG. 16 is a timing chart illustrating the drop frame number and the ejection volume.

In FIG. 16, the timer set Ta is used for the first drop frame and the second drop frame, the timer set Tb is used for the third drop frame and the fourth drop frame, and the timer Tc is used for the fifth drop frame, and the drop frames after the fifth drop. That is, when considering the first drop frame and the second drop frame, the third drop frame and the fourth drop frame, the fifth drop frame and the drop frames after the fifth drop frame as three groups, the ejection volumes at drop frames in the same group are identical to each other, and the ejection volumes at drop frames in different groups are different from each other. Though only the first drop frame~the seventh drop frame are shown in FIG. 16, the eighth drop frame and the drop frame after the eighth drop frame may be added similar to the fifth drop frame to the seventh drop frame.

The setting time t2 of the timer set Tc is adjusted in such a manner that the time used to fill the pressure chamber with ink becomes ½ of the natural vibration period of ink in the pressure chamber, and the ejection amount per droplet of ink is 6.5 pl in the driving waveform using the timer set.

In order to eject ink of 6 pl (pico liter) in the timer set Tb and to eject ink of 5.5 pl in the timer set Ta, the setting time t2 in each of the timer set Tb and the timer set Ta is set to be shorter than the setting time t2 in the timer set Tc and the driving waveform is adjusted.

That is, as shown in FIG. 16, the volumes of ink ejected by the channel at timings of the first drop frame and the second drop frame are respectively 5.5 pl (pico liter). Further, the volumes of ink ejected by the channel at timings of the third drop frame and the fourth drop frame are respectively 6 pl. The volumes of ink ejected by the channel at timings of the fifth drop frame to the seventh drop frame are respectively 6.5 pl.

Herein, it is assumed that the channel ejects ink three times.

As shown in FIG. 16, if a channel ejects ink three times from the first drop frame, the channel can eject 17 pl of ink in total on the printing medium. Further, if a channel ejects ink three times from the second drop frame, the channel can eject 17.5 pl of ink in total on the printing medium. Similarly, if a channel ejects ink three times from the third drop frame, the channel can eject 18.5 pl of ink in total on the printing medium. If a channel ejects ink three times from the fourth drop frame, the channel can eject 19 pl of ink in total on the printing medium. If a channel ejects ink three times from the fifth drop frame, the channel can eject 19.5 pl of ink in total on the printing medium.

The number of drop frames may be increased to maintain the capable number of drops to be ejected even in a case in which the drop frame number starting to be ejected is shifted back. For example, in a case of starting to eject ink from the fourth drop frame, the number of drop frames may be increased up to 10 (add 3 frames), for 7 drops capable of being ejected.

Next, an example carrying out a volume fine adjustment in a case of ejecting ink 7 times continuously by a plurality of channels is described with reference to FIG. 17. In this example, it is assumed that the setting of each timer set is the same as that shown in FIG. 16, and the number of drop frames is 10.

Figure 17:
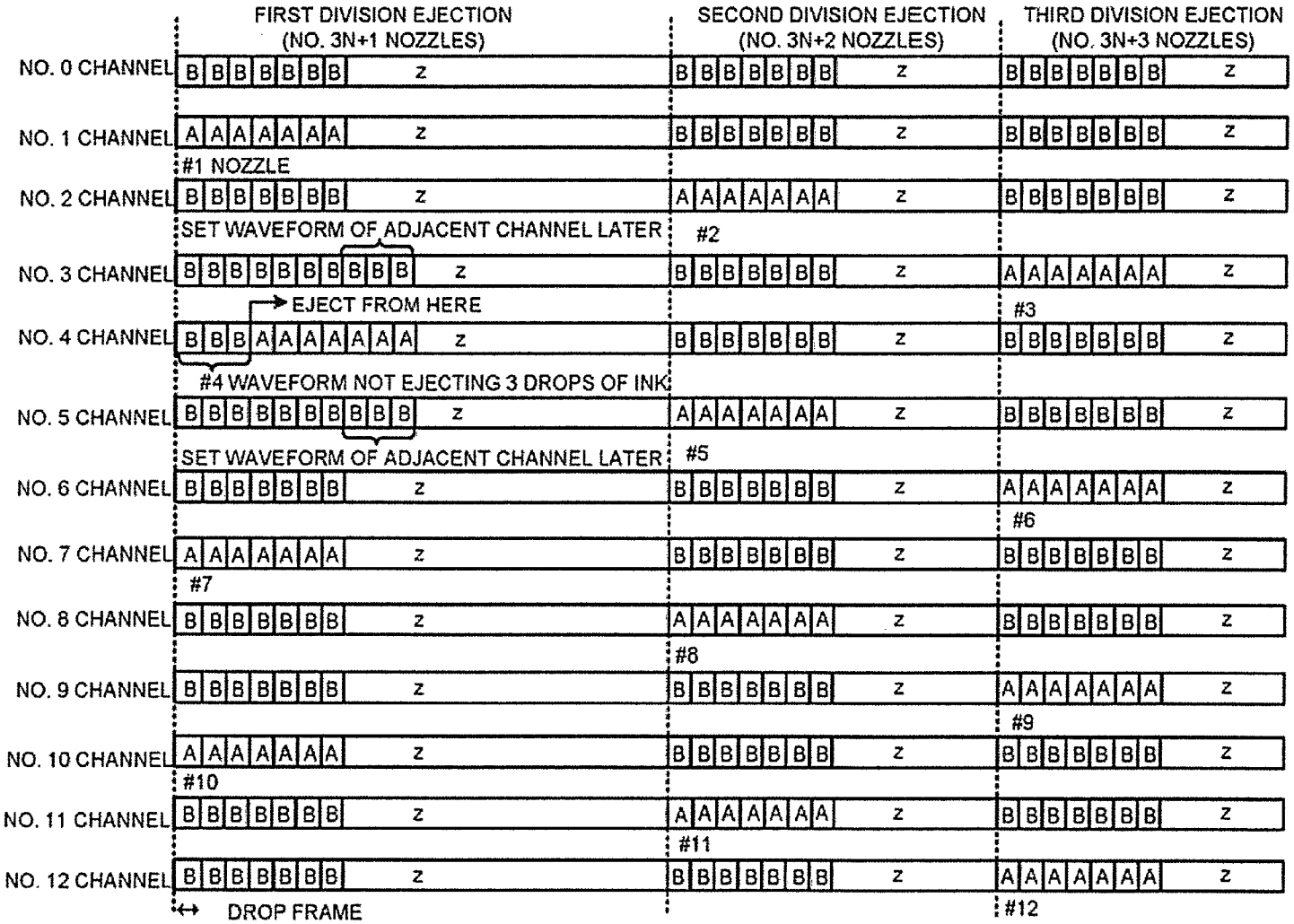
FIG. 17 is a timing chart illustrating the timings at which the ejection section ejects ink drops according to the embodiment.

FIG. 17 is a timing chart illustrating the timings when the channels eject ink.

FIG. 17 illustrates the ejection operations of each channel of the first division, the ejection operations of each channel of the second division and the ejection operations of each channel of the third division respectively.

In FIG. 17, "A" represents that the corresponding channel ejects ink. That is, "A" represents that an ACT voltage is applied to the channel. "B" represents that the corresponding channel doesn't eject ink. That is, "B" represents that an INA voltage, a NEG voltage or a NEGINA voltage is applied to the channel. No driving waveform is applied to the part marked with "Z", that is, the three transistors connected with the electrodes of the channel in FIG. 11 are turned off.

As shown in FIG. 17, when a given period elapses after the ejection operations of a given division are ended, the ejection operations of the next division are started.

In this example, when ejecting ink 7 times continuously, only the ejection amount of ink ejected from the fourth channel of the first division, that is, from the #4 nozzle is adjusted to be finely increased when compared with that from other nozzles.

The fourth channel of the first division starts to eject ink from the fourth drop frame. In order to eject ink 7 times in the fourth channel, the driving circuit 22 increases the number of the drop frame which is the times frame capable of ejecting ink to 10, to eject ink droplets at the fourth drop frame to the tenth drop frame. In this way, the fourth channel can drop ink 7 times. At that time, the driving circuit 22 also increases the times frame in the adjacent channels (that is, the third channel and the fifth channel). That is, an INA voltage is applied to the adjacent channels from the eighth drop to the tenth drop.

As the timer sets are set as described in FIG. 16, total ejection amount of the general 7 drops (other than the drops from the #4 nozzle) is 5.5+5.5+6+6+6.5+6.5+6.5=42.5 pL.

On the other hand, as the timer sets which are shifted back for 3 drop frames are used when ink is ejected from the #4 nozzle, the total ejection amount of the 7 drops from the #4 nozzle is 6+6.5+6.5+6.5+6.5+6.5+6.5=45 pL.

That is, by shifting the drop frame number starting to be ejected back with 3, the ejection amount can be increased by 2.5 pL. Similarly, if the drop number starting to be ejected is shifted back with 2, the total ejection amount becomes 6+6+6.5+6.5+6.5+6.5+6.5=44.5 pL; and if the drop number starting to be ejected is shifted back with 1, the total ejection amount becomes 5.5+6+6+6.5+6.5+6.5+6.5=43.5 pL. As a result, the 7 drops of total ejection amount can be respectively increased by 2 pL, 1 pL when compared to the general 42.5 pL.

In a printing with a multi-drop system in which one dot is formed through a plurality of droplets by times of operations of the general actuator, ejection volume of one droplet by once in the plurality of times of operations is the minimum adjustment step of the ejection amount. That is, for example, if the ejection amount of one drop is 6 pL, the ejection volume cannot be finely adjusted by an amount below 6 pL. On the contrary, the 2.5 PL, 2 pL and 1 pL in the present embodiment are about below half of 6 pL serving as the adjustment step in a case of increasing/decreasing the ejection amount per drop unit, and thus it is possible to finely adjust the ejection amount.

Though it is exemplified in this example that the ejection volume of the #4 nozzle is finely increased, it is possible to finely increase or decrease the ejection volume of any one of nozzles at any timing similarly, as the setting values described above can be changed freely.

Since the timer sets can be set freely, the adjustment width of the fine adjustment and the position where the adjustment enters may be selected freely.

The spot positions of the ink on a print media are shifted slightly in a direction that the inkjet head and the printing medium are moved relatively, i.e., in the direction orthogonal to the direction of nozzle row through the fine adjustment. For example, in the example shown in FIG. 17, when three-drop frames are shifted, the shift amount of the spot positions is maximum 3/30=10% of the image resolution degree on the printing medium. If a printing application for printing on a general paper medium is carried out, the ink spots which are very close to each other on the paper gather together by the surface tension thereof and the ink permeates and spreads on the paper slightly. Thus such a slight change of the spot positions can be hardly detected on the printing object. So, it is possible to shift the drop frame number starting to be ejected to perform a fine adjustment of ejection volume. On the contrary, if such a slight change of printing positions can be detected, the appearance of the printing object may be regulated by utilizing the slight change of printing positions in a positive manner and combining the volume fine adjustment with a position fine adjustment.

Further, if the printing medium is not normal paper but the one which has fine dispensing grooves to which ink is dispensed, even if there is a slight shift of printing positions in a direction that the inkjet head and the printing medium are moved relatively, i.e., the direction orthogonal to the direction of nozzles row, the shift of printing positions is permissible, since the ink is dispensed to the same dispensing groove. Further, in a case of ejecting ink in a static state by fixing the relative position of the printing medium and the inkjet head one by one, a slight shift of timings for adjusting volumes is permissible.

The inkjet head with the constitution above can adjust the drop frame number starting to be ejected for each drop. Thus, the inkjet head can effectively adjust the amount of ink to be ejected on the printing medium.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An inkjet head which forms a first dot and a second dot each of which is formed through a plurality of ink droplets on a printing medium, comprising:

an ejection section configured to eject the plurality of ink droplets according to a plurality of times of operations of an actuator; and a driving section configured to apply voltages to the actuator of the ejection section such that the ejection section ejects ink based on first printing data indicating a first number (M) of drop frames corresponding to the times that the ejection section ejects ink continuously and a first position flag designating a drop frame number (S1) where ink starting to be ejected in the first printing data, wherein M and S1 denote positive integers respectively and the first dot is formed within a drop frame range from S1 to S1+M−1, and a second printing data indicating a second number of drop frames which is the same as the first number (M) of drop frames and corresponds to the times that the ejection section ejects ink continuously and a second position flag designating another drop frame number (S2) different from the drop frame number (S1) where ink starting to be ejected in the second printing data to form the second dot, total ink volume of which is different from total ink volume of the first dot, wherein the another drop frame number (S2) designated by the second position flag resides within the drop frame range.

2. The inkjet head according to claim 1, wherein the driving section comprises:

a first storage section configured to store patterns of the voltages applied to the actuator;

a second storage section configured to store a plurality of timer sets;

a waveform generation section configured to select one of the plurality of timer sets that are stored in the second storage section and generate a waveform of a voltage applied to the actuator based on the selected timer set and the voltage pattern that is stored in the first storage section for the timing of each drop; and a voltage applying section configured to apply a voltage to the actuator based on the waveform generated by the waveform generation section.

3. An ink jet printing apparatus which forms an image on a printing medium, comprising:

an inkjet head which forms a first dot and a second dot each of which is formed through a plurality of ink droplets on the printing medium including, an ejection section configured to eject the plurality of ink droplets according to a plurality of times of operations of an actuator, a driving section configured to apply voltages to the actuator of the ejection section such that the ejection section ejects ink based on first printing data indicating first number (M) of drop frames corresponding to the times that the ejection section ejects ink continuously and a first position flag designating a drop frame number (S1) where ink starting to be ejected in the first printing data wherein M and S1 denote positive integers respectively and a first dot is formed within a drop frame range from S1 to S1+M−1, and second printing data indicating a second number of drop frames which is the same as the first number (M) of drop frames and corresponds to the times that the ejection section ejects ink continuously and a second position flag designating another drop frame number (S2) different from the drop frame number (S1) where ink starting to be ejected in the second printing data to form the second dot, total ink volume of which is different from total ink volume of the first dot, wherein the another drop frame number (S2) designated by the second position flag resides within the drop frame range; and a conveyance section configured to convey a printing medium to positions where the inkjet head ejects ink.

* * * * *